US008307772B2

(12) United States Patent
Nakashima et al.

(10) Patent No.: US 8,307,772 B2
(45) Date of Patent: Nov. 13, 2012

(54) SEWING MACHINE

(75) Inventors: Akifume Nakashima, Ichinomiya (JP); Daisuke Ueda, Owariasahi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 382 days.

(21) Appl. No.: 12/656,236

(22) Filed: Jan. 21, 2010

(65) Prior Publication Data

US 2010/0212561 A1 Aug. 26, 2010

(30) Foreign Application Priority Data

Feb. 23, 2009 (JP) ..... 2009-039309

(51) Int. Cl.
*D05B 23/00* (2006.01)

(52) U.S. Cl. ..... 112/2

(58) Field of Classification Search ..... 112/2, 240, 112/274, 277, 281, 221, 235, 244, 245, 246
See application file for complete search history.

(56) References Cited

U.S. PATENT DOCUMENTS

| | | | | |
|---|---|---|---|---|
| 5,097,778 | A * | 3/1992 | Niino | 112/311 |
| 5,284,104 | A * | 2/1994 | Hori et al. | 112/102.5 |
| 5,653,185 | A * | 8/1997 | Badillo | 112/240 |
| 7,966,955 | B2 * | 6/2011 | Niizeki | 112/89 |

FOREIGN PATENT DOCUMENTS

| | | |
|---|---|---|
| JP | U-63-196672 | 12/1988 |
| JP | A-1-320195 | 12/1989 |
| JP | U-3105746 | 11/2004 |

* cited by examiner

*Primary Examiner* — Tejash Patel
(74) *Attorney, Agent, or Firm* — Oliff & Berridge, PLC

(57) ABSTRACT

A sewing machine including a presser foot that presses a workpiece, a presser bar that has a lower end allowing detachable attachment of the presser foot; a presser bar vertically moving mechanism that moves the presser bar up and down; a presser bar driver that drives the presser bar vertically moving mechanism; a needle plate that has an upper surface for placing the workpiece; a projecting element that is detachably attached to the presser bar and that is driven up and down with the presser bar as the presser bar is driven up and down by the presser bar driver through the presser bar vertically moving mechanism to form embosses on the workpiece by downwardly pressing the workpiece; and a receiving section that is provided on the upper surface of the needle plate that opposes the projecting element to receive a tip of the projecting element.

8 Claims, 10 Drawing Sheets

110

| 113 M | 114 X | 115 Y | 116 DEPTH |
|---|---|---|---|
| 0 | 0.000 | 0.000 | 3 |
| 0 | + 1.000 | 0.000 | 5 |
| 0 | + 0.500 | + 0.866 | 3 |
| 0 | − 0.500 | + 0.866 | 3 |
| 0 | − 1.000 | 0.000 | 4 |
| 0 | − 0.500 | − 0.866 | 5 |
| 0 | + 0.005 | − 0.866 | 2 |
| 0 | +11.000 | 0.000 | 1 |
| 0 | +10.005 | + 0.866 | 1 |
| | | | |
| | | | |
| 1 | + 5.000 | 0.000 | 0 |
| 1 | + 3.536 | + 3.536 | 0 |
| 1 | 0.000 | + 5.000 | 0 |
| 1 | − 3.536 | + 3.536 | 0 |
| | | | |

111

112

FIG. 6

SEWING MACHINE

CROSS-REFERENCE TO RELATED APPLICATIONS

This application is based upon and claims the benefit of priority from the prior Japanese Patent Application 2009-039309, filed on Feb. 23, 2009, the entire contents of which are incorporated herein by reference.

FIELD

The present disclosure relates to a sewing machine suitable for use in parchment crafting in which ornaments are created by forming embosses and holes on, for instance, a thick tracing paper.

BACKGROUND

One of popular techniques in creating ornaments is pattern formation on workpiece such as paper and cloth, for instance, by way of embosses and holes. Examples of such techniques are embossing the workpiece with dot impact devices or manually embossing cardboards using emboss templates that outline various patterns.

Resent trend in paper art is parchment crafting in which ornaments are created by manually forming embosses and holes on workpiece such as a thick tracing paper.

The problem with the dot impact device mentioned earlier is that it is not fit for general use in commercial art and personal hobbies such as arts and crafts because its is oversized and limited in application. The emboss template, on the other hand, requires dedicated templates for each type of pattern and thus the number of templates increases with the number of patterns. Moreover, because the patterns are formed by hand, the work involves complexity and is time consuming.

SUMMARY

An object of the present disclosure is to provide a sewing machine suitable for use in parchment crafting and that facilitates formation of complex patterns made of multiplicity of embosses and holes by employing mechanisms and devices that have been provided on conventional sewing machines.

In one aspect of the present disclosure a sewing machine includes a presser foot that presses a workpiece; a presser bar that has a lower end allowing detachable attachment of the presser foot; a presser bar vertically moving mechanism that moves the presser bar up and down; a presser bar driver that drives the presser bar vertically moving mechanism; a needle plate that has an upper surface for placing the workpiece; a projecting element that is detachably attached to the presser bar and that is driven up and down with the presser bar as the presser bar is driven up and down by the presser bar driver through the presser bar vertically moving mechanism to form embosses on the workpiece by downwardly pressing the workpiece; and a receiving section that is provided on the upper surface of the needle plate that opposes the projecting element to receive a tip of the projecting element.

BRIEF DESCRIPTION OF THE DRAWINGS

Other objects, features and advantages of the present disclosure will become clear upon reviewing the following description of the illustrative aspects with reference to the accompanying drawings, in which.

FIG. 6 schematically indicates a data structure of pattern data;

DETAILED DESCRIPTION

With reference to the drawings, a description will be given hereinafter on an exemplary embodiment of the present disclosure implemented as a sewing machine. The following description will be based upon an assumption that the directions represented in FIG. 1, indicate the front and rear, left and right, and up and down of the sewing machine, which are hereinafter also represented as the X direction, Y direction, and Z direction respectively. The sewing machine according to the present exemplary embodiment is not only capable of sewing a workpiece cloth as it is normally used, but is also capable of parchment crafting. The workpiece commonly used in parchment crafting are materials such as tracing papers and cardboards. The present exemplary embodiment is based on, but not limited to, a household sewing machine.

Figure 1:
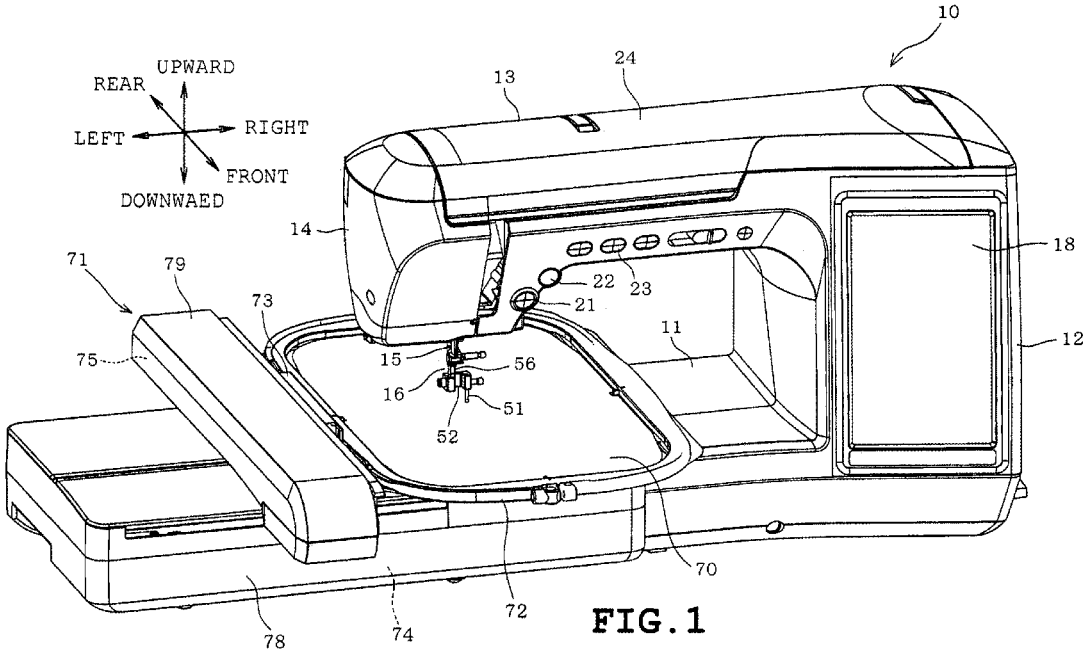
FIG. 1 is a perspective view of a sewing machine according to an exemplary embodiment of the present disclosure as viewed from the front side.
Figure 2:
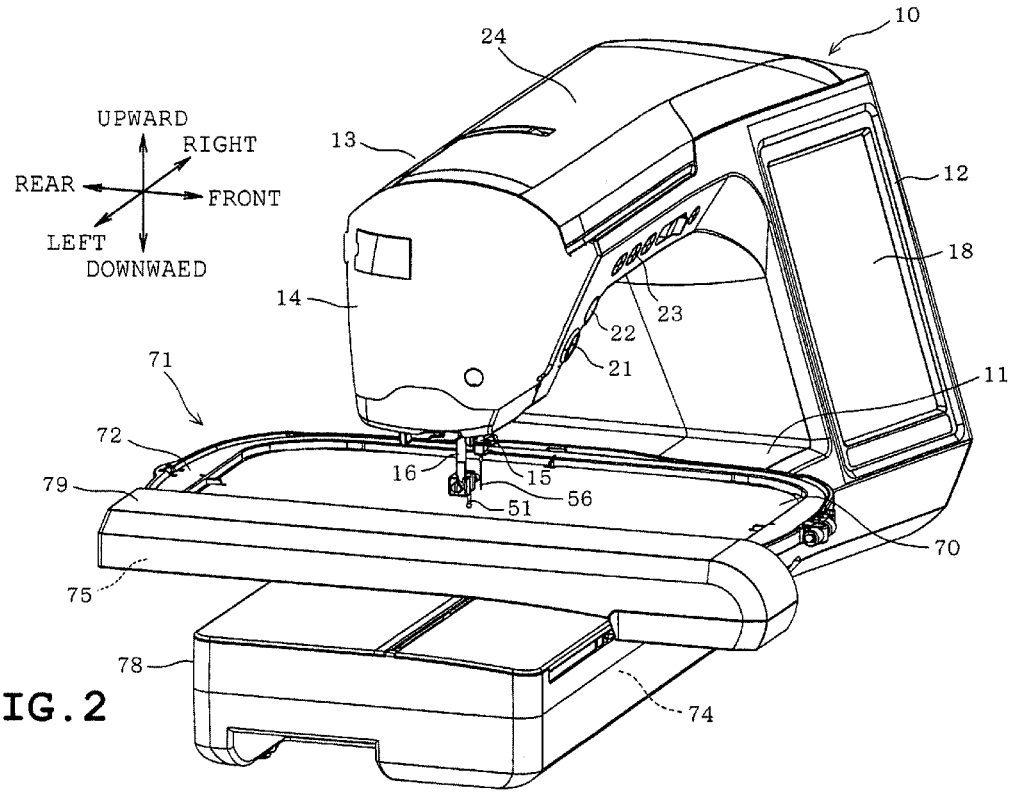
FIG. 2 is a perspective view of the sewing machine according to the exemplary embodiment as viewed from the left side.

Referring to FIGS. 1 and 2, sewing machine 10 according to the present exemplary embodiment includes bed 11, pillar 12, arm 13, head 14, needle bar 15, and presser bar 16. Pillar 12 extends upward from the right end of the bed 11. From the upper end of pillar 12, arm 13 extends leftward over bed 11 and the left end extreme of arm 13 defines head 14. Bed 11 is provided with needle plate 17 which is coplanar with the upper surface of bed 11. Within bed 11 below needle plate 17 are components such as a shuttle mechanism and feed mechanism not shown. Shuttle mechanism has a bobbin not shown detachably attached to it which is wound with a bobbin thread. The feed mechanism drives a feed dog not shown for transferring a workpiece cloth not shown. As shown in FIGS. 1 and 2, pillar 12 has LCD 18 on its front face whereas on the lower front face of arm 13, various switches such as sewing start switch 21, sewing end switch 22 and presser foot vertically moving switch 23 are provided.

On the upper side of arm 13, openable/closable cover 24 is provided which extends in the left and right direction along the entire length of arm 13. Cover 24 is pivoted about a rotary shaft not shown that is provided on the upper rear end side of arm 13 so that it may open/close the upper portion of arm 13.

Figure 3:
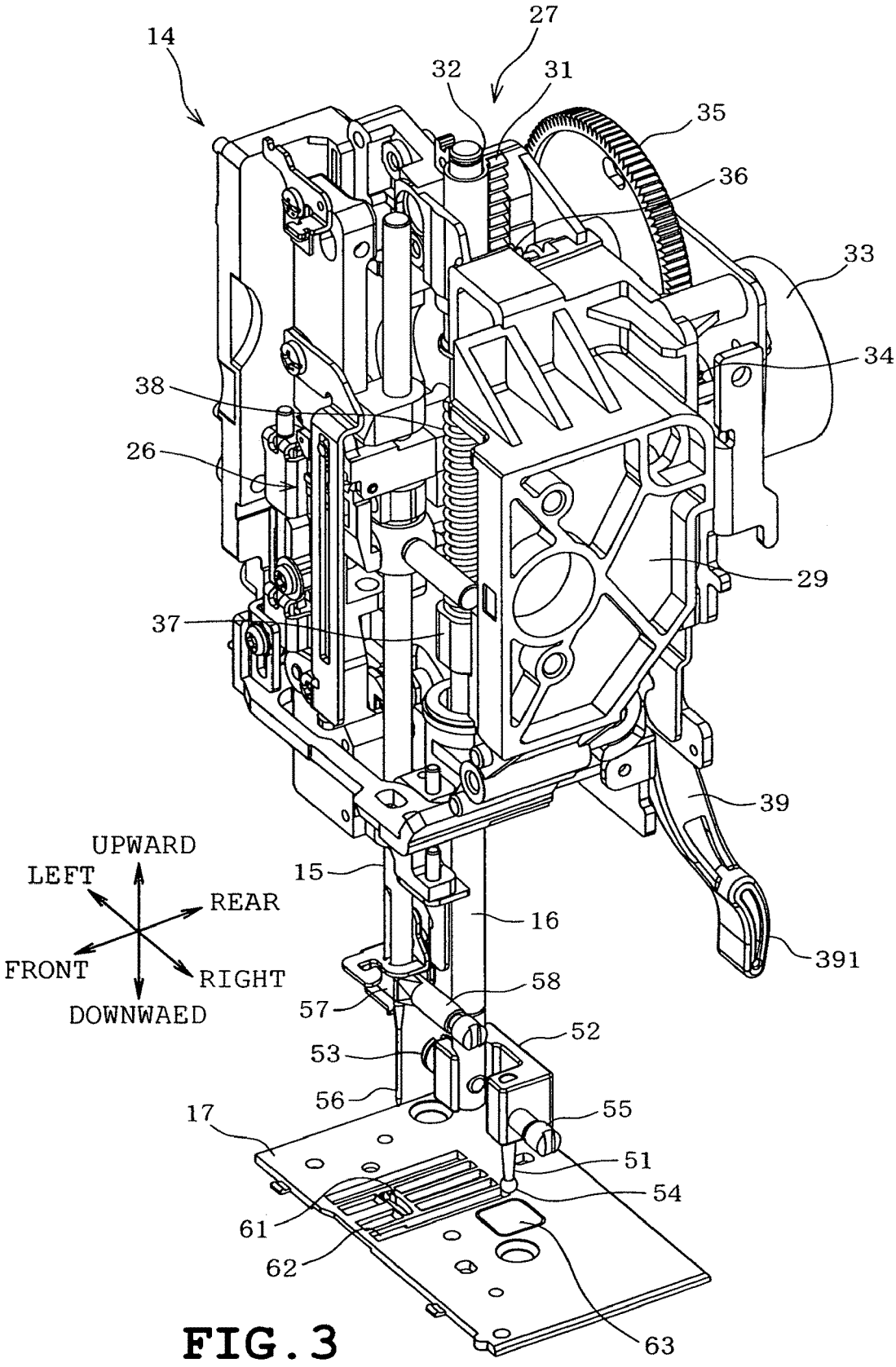
FIG. 3 is a perspective view indicating a needle bar vertically moving mechanism and a presser bar vertically moving mechanism provided within a head of the sewing machine of the present exemplary embodiment.

Within arm 13 below cover 24, is a thread storage not shown which stores a thread spool also not shown being wound with needle thread. Needle bar 15 is provided in head 14 and as shown in FIG. 3, is supported reciprocably up and down by sewing machine frame 29 which constitutes head 14. Needle bar 15 is reciprocated up and down by needle bar vertically moving mechanism 26. Needle bar vertically moving mechanism 26 is driven by the drive force of sewing machine motor 30 shown in FIG. 4 by way of sewing machine drive mechanism not shown which is provided with components such as a main shaft. The configuration of sewing machine drive mechanism which is well known in the art will not be described.

Figure 4:
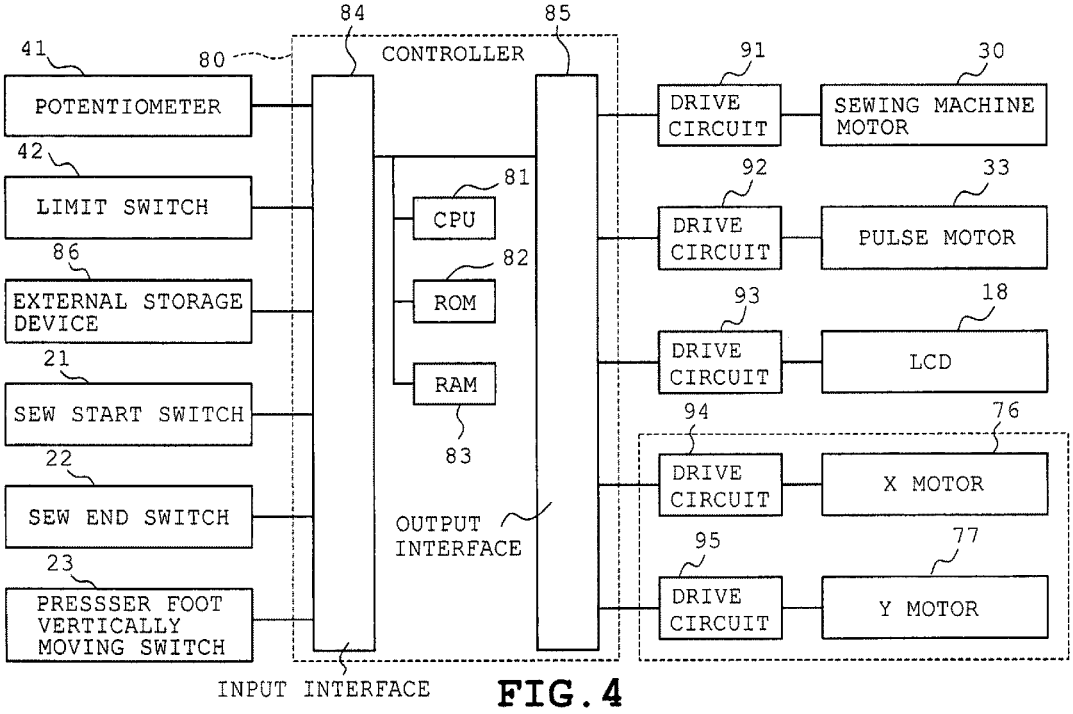
FIG. 4 is a block diagram indicating an electrical configuration of the sewing machine according to the exemplary embodiment.

As shown in FIG. 3, behind needle bar 15, presser bar vertically moving mechanism 27 is provided that drives presser bar 16 up and down. Presser bar vertically moving mechanism 27 includes components such as rack 31, stop ring 32, pulse motor 33, drive gear 34, intermediate gear 35, pinion gear 36, presser bar clamp 37, needle bar 16, press spring 38, presser foot lifting lever 39, and potentiometer 41 as shown in FIG. 4. As shown in FIG. 3, rack 31 is mounted on the upper end of presser bar 16 so as to be movable up and down and stop ring 32 is secured on the upper end of presser bar 16. Pulse motor 33 generates the drive force for driving needle bar 16 up and down and is secured by sewing machine frame 29 at the immediate right side of rack 31. Drive gear 34 is mounted on the output shaft of pulse motor 33. Intermediate gear 35 is in mesh with drive gear 34. Pinion gear 36 is formed integrally with intermediate gear 35 and is in mesh with rack 31. Presser bar clamp 37 is secured on a vertical mid portion of presser bar 16. Press spring 38 is mounted on a portion of presser bar 16 between rack 31 and presser bar clamp 37. Presser foot lifting lever 39 is manually operated to vertically move presser bar 16 independent of the vertical movement of presser bar 16 by pulse motor 33. Potentiometer 41 is provided on the left side of presser bar 16 and detects the vertical position of presser bar clamp 37, in other words, the vertical position of presser bar 16.

Potentiometer 41 comprises rotary potentiometer and has a lever not shown that extends rightward from a rotary shaft of potentiometer 41 that is placed in consistent contact with an upper surface of a protrusion protruding leftward from presser bar clamp 37. Thus, when presser bar clamp 37 is elevated by the elevation of the presser bar 16, the lever is swung to alter the resistance of potentiometer 41. The position of presser bar 16 is detected based on a voltage outputted depending upon the variation of the resistance.

One end of presser foot lifting lever 39 is pivoted about a pin not shown secured on sewing machine frame 29. On the other end of presser foot lifting lever 39, handle 391 is provided to allow manual operation by the user. By manually operating handle 391, presser foot lifting lever 39 can be moved from the lowered position to the elevated position. By swinging presser foot lifting lever 39, presser bar 16 can be moved up and down without being driven by the drive fore of pulse motor 33. In the proximity of presser foot lifting lever 39, limit switch 42 is provided as shown in FIG. 4 that is switched on and off in coordination with the operation of presser foot lifting lever 39. Limit switch 42 detects the vertical position or the height of presser foot lifting lever 39.

At the lower end of presser bar 16, a projecting element 51 or a presser foot not shown may be detachably attached. When executing a sewing operation with sewing machine 10, the presser foot is attached to the lower end of presser bar 16, whereas a projecting element 51 is attached when parchment crafting. Projecting element 51 is attached to the lower end of presser bar 16 through adapter 52. Adapter 52 is screw fastened at the lower end of presser bar 16 by screw 53. Projecting element 51 is bar-shaped having its upper end inserted into adapter 52 and its lower end being provided with pointed tip 54. Projecting element 51 inserted into adapter 52 is securely fastened by screw 55. Pointed tip 54 may be a ball point tip, for instance, as shown in FIG. 3, or columnar point tip though not shown and may come in various shapes and sizes. By replacing projecting element 51 by loosening/tightening screw 55, the shapes and sizes of pointed tip 54 placed in contact with the workpiece may be varied as required.

Pulse motor 33, when driven, imparts its drive force to intermediate gear 35 and pinion gear 36 to cause rack 31 to be driven up and down. When rack 31 is elevated, the upper end of rack 31 elevates stop ring 53 secured on the upper end of presser bar 16, consequently elevating projecting element 51 attached to presser bar 16. When pulse motor 33 is driven to lower rack 31, press spring 38 placed in contact with the lower end underside of rack 31 is pressed downward. Thus, presser bar clamp 37 secured on presser bar 16 is pressed downward as well to consequently transfer pointed tip 54 of projecting element 51 toward needle plate 17. As described above, presser bar 16 having projecting element 51 attached to it is driven up and down so as to reciprocate between the upper position and the lower position by pulse motor 33. The upper position indicates the uppermost end of the reciprocable range of presser bar 16, whereas the lower position indicates the lowermost end of the reciprocable range.

Needle bar 15 allows selective and detachable attachment of needle 56 or sewing needle not shown at its lower end. When executing a sewing operation with sewing machine 10, sewing needle not shown is attached to the lower end of needle bar 15, whereas needle 56 is attached at the lower end of needle bar 15 when parchment crafting. Needle 56 is attached to needle bar 15 by way of needle clamp 57. Needle 56 is attached to the lower end of needle bar 15 by tightening screw 58 of needle clamp 57. Needle 56 is bar shaped and has an upper end attached to needle bar 15 byway of needle clamp 57 whereas the lower end terminates into a sharp point. Unlike the sewing needle, the tip of needle 56 does not have a needle eye. Needle bar 15 is reciprocated up and down between the upper position and the lower position by the drive force of sewing machine motor 30 imparted by needle bar vertically moving mechanism 26. The upper position indicates the uppermost end of the reciprocable range of needle bar 15, whereas the lower position indicates the lowermost end of the reciprocable range.

Needle plate 17 is provided on the upper surface of bed 11 at a position opposing the lower ends of needle bar 15 and presser bar 16. Needle plate 17 has a needle hole 61 and receiving section 63. Needle hole 61 is formed on the line of extension from needle 56 attached to needle bar 15. Thus, as needle bar 15 is lowered, needle 56 enters needle hole 61 and exits needle hole 61 as needle bar 15 is elevated. Thus, as presser bar 16 is lowered, projecting element 51 contacts receiving section 63 and as presser bar 16 is elevated, projecting element 51 cancels the contact with receiving section 63. Receiving section 63 has a buffer element made of elastic material such as rubber to reduce the shock and noise imparted when projecting element 51 contacts receiving section 63 as it is moved up and down with presser bar 16.

According to the present exemplary embodiment, projecting element 51 is attached to presser bar 16 by way of adapter 52. Thus, the axis on which needle bar 16 reciprocates is not collinear with axis on which the projecting element 51 reciprocates. Such arrangement allows receiving section 63 to be located in a position displaced from square holes 62 formed on needle plate 17 through which the feed dog, not shown, protrudes and retracts as shown in FIG. 3. This means that both normal sewing operation and parchment crafting can be executed with a common needle plate without having to prepare a dedicated needle plate for each task. When parchment crafting, the feed dog is maintained at a position that does not protrude from the upper surface of needle plate 17 by a feed dog lowering mechanism not shown.

Sewing machine 10 according to the present exemplary embodiment is provided with a transfer device 71 that transfers workpiece 70 in the X and Y directions as can be seen in FIGS. 1 and 2. Transfer device 71 is provided with frame 72, carriage 73, X-direction transfer mechanism 74, and Y-direction transfer mechanism 75. X-direction transfer mechanism 74 is contained in casing 78 of transfer device 71 detachably attached to bed 11. Y-direction transfer mechanism 75 is located immediately above casing 78 and is contained in cover 79. Frame 72 supports workpiece 70 such as a tracing paper, and frame 72 is in turn supported by carriage 73. Y-direction transfer mechanism 75 transfers carriage 73 in the front and the rear direction represented as the Y-direction. X-direction transfer mechanism 74 is provided below Y-direction transfer mechanism 75 and transfers carriage 73 as well as Y-direction transfer mechanism 74 in the left and right direction represented as the X-direction. As shown in FIG. 4, X-direction transfer mechanism 74 is provided with X motor 76 that drives Y-direction transfer mechanism 75 in the X direction. Similarly, Y-direction transfer mechanism 75 is provided with Y motor 77 that drives carriage 73 in the Y direction. X motor 76 is contained in casing 78 whereas Y motor 77 is contained in cover 79. X-direction transfer mechanism 74 and Y-direction transfer mechanism 75 will not be described in detail since they are known components of transfer device 71.

Next, a description will be given on a control system of sewing machine 10.

Sewing machine 10 is provided with controller 80 as shown in FIG. 4. Controller 80 comprises a microcomputer primarily configured by CPU 81, ROM 82, and RAM 83; input interface 84; and output interface 85. Input interface 84 establishes electrical connection with external storage device 86, switches such as sewing start switch 21, potentiometer 41, and limit switch 42. Output interface 85, on the other hand, establishes electrical connection with sewing machine motor 30, pulse motor 33, liquid crystal display 18 hereinafter also described as LCD 18, and X and Y motors 76 and 77 of transfer device 71 by way of corresponding drive circuits 91 to 95. External storage device 86 is configured by nonvolatile memory such as EEPROM and hard disc drive.

ROM 82 stores a control program that controls sewing machine 10. The control program is a collection of programs such as a sewing program for executing a sewing operation, parchment crafting program for executing parchment crafting, and display control program for displaying various information on LCD 18. The control program may also be stored in whole or in part in the external storage device 86 other than ROM 82.

Figure 5:
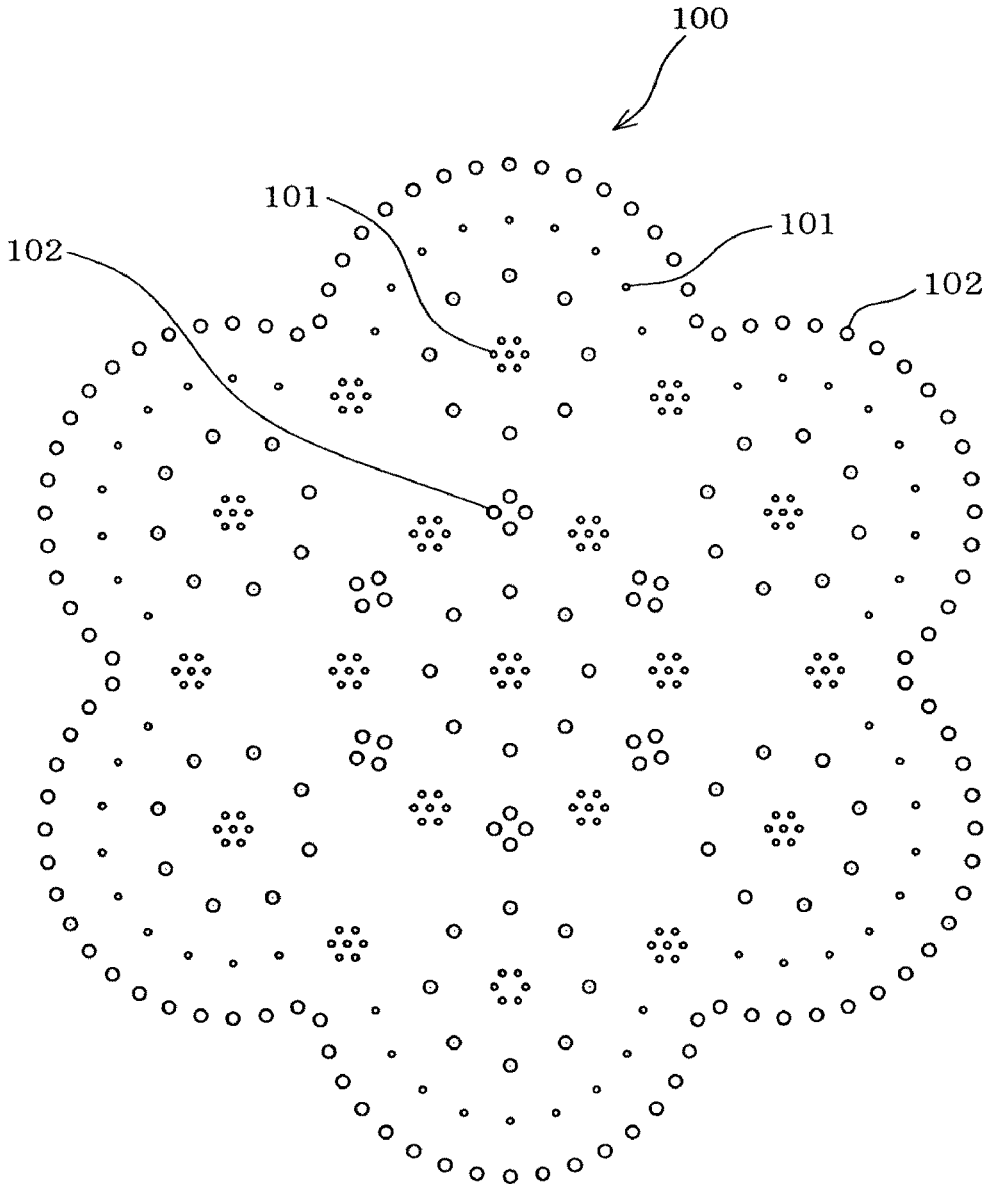
FIG. 5 is a schematic view indicating an exemplary layout of embosses and holes that constitute a pattern.

Controller 80 controls the drive of various components through execution of the above described programs in forming patterns such as pattern 100 shown in FIG. 5 based on the corresponding pattern data. For instance, needle bar 15, presser bar 16, and frame 72 that supports workpiece 70 are driven by sewing machine motor 30, pulse motor 33, and X and Y motors 76, and 77 respectively according to their relevant programs. Controller 80 specifies the vertical movement amount of needle bar 16, that is, the distance traveled toward receiving section 63 based on the pattern data.

As shown in FIG. 6, pattern data 110 is specified to produce a given pattern such as pattern 100 shown in FIG. 5, and is configured by embossing data 111 and holing data 112. Referring now to FIG. 5, small circles 101 each represent the center of location where emboss is formed by projecting element 51, whereas large circles 102 each represent the center of location where hole is formed by needle 56. As can be seen in FIG. 6, embossing data 111 and holing data 112 constituting pattern data 110 each includes a flag identified as "m value 113" that indicates whether it is embossing data 111 or holing data 112, and coordinates representing where the emboss or the hole is formed which are given in the form of "X-coordinate 114" and "Y-coordinate 115". To elaborate, "0" is set to "M value 113" when the given data is embossing data 111 for forming the emboss and "1" is set when the given data is holing data 112 for forming the hole. For instance, pattern data 110 of the present exemplary embodiment shown in FIG. 6, is represented by a series of embossing data 111 having "0" set to "m value 113" and holing data 112 having "1" set to "m value 113". ROM 82 or external storage 86 not only store pattern data 110 corresponding to pattern 100 shown in FIG. 5 but also multiple pattern data corresponding to multiplicity of other patterns. Thus, the user is allowed to select a given pattern from the images of patterns 100 displayed on LCD 18 based on each pattern data 110, for instance.

Embossing data 111 further includes "depth 116" that specifies the depth of emboss, and "depth 116" is specified for each individual emboss. "Depth 116" corresponds to the movement amount of projecting element 51 attached to presser bar 16. When employing tracing paper as workpiece 70, the density or contrast of emboss varies depending on the depth of the emboss formed on the tracing paper. To elaborate, when the movement amount of projecting element 51 is relatively large to form a relatively deep emboss, the emboss shows relatively greater contrast so as to appear increasingly white, whereas when the movement amount of projecting element 51 is relatively small to form a relatively shallow emboss, the emboss shows relatively less contrast so as to appear less white. Thus, by specifying "depth 116" for each individual emboss, the movement amount of projecting element 51 is specified and the depth of emboss formed on workpiece 70 can be controlled.

As one may assume, "depth 116" need not be given by an actual measurement such as "0.5 mm" and "1.2 mm" but may be given in relative scales or levels such as "1" to represent the shallowest emboss, and increased to "2", "3" and so on as depth is increased, and "0" may be specified for "depth 116" if no emboss is to be formed. As described above, controller 80 controls the movement amount of projecting element 51 attached to presser bar 16 based on the actual measurement of "depth 116" or levels of "depth 116".

Figure 7:
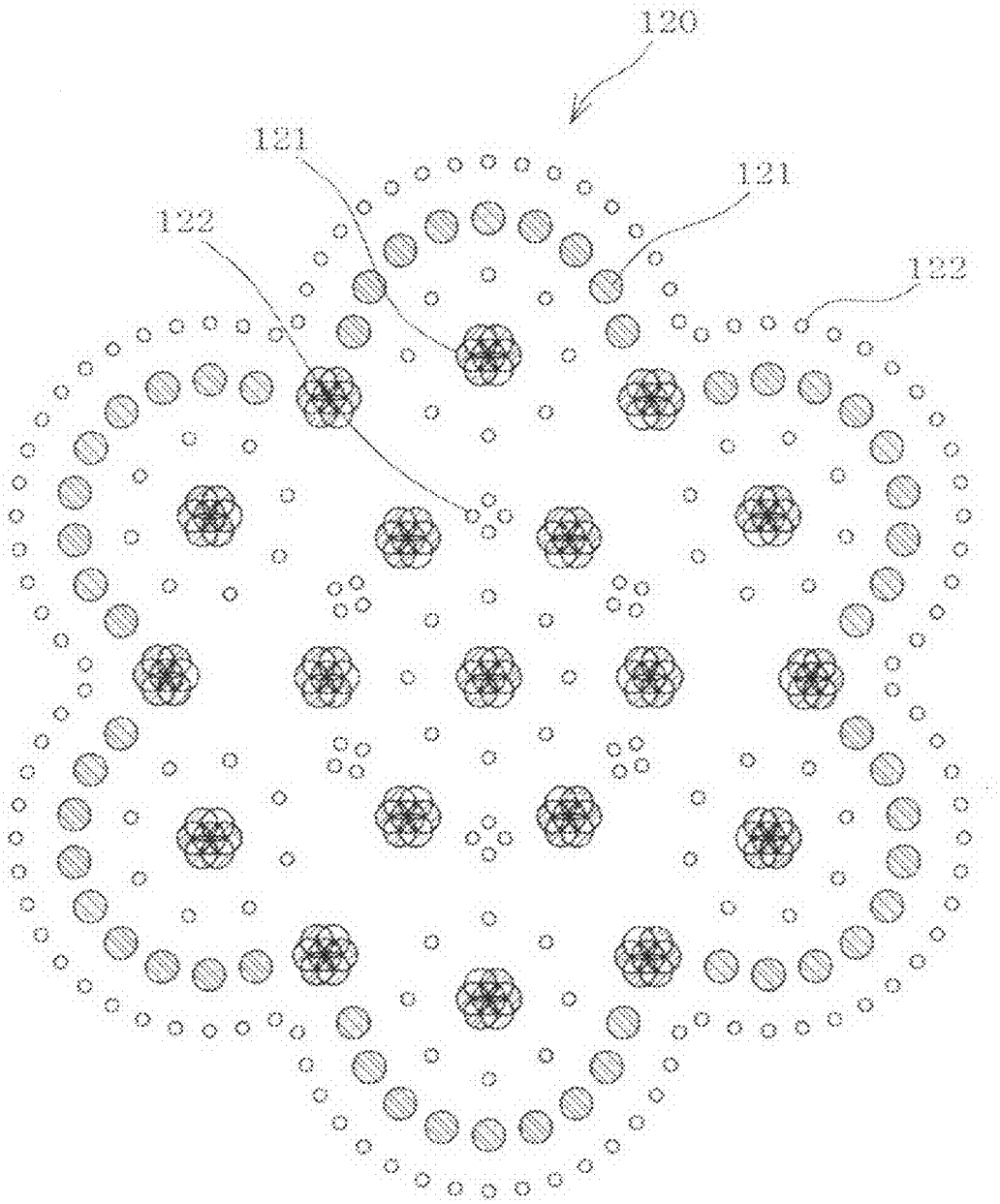
FIG. 7 schematically illustrates embosses and holes that constitute a pattern.
Figure 8:
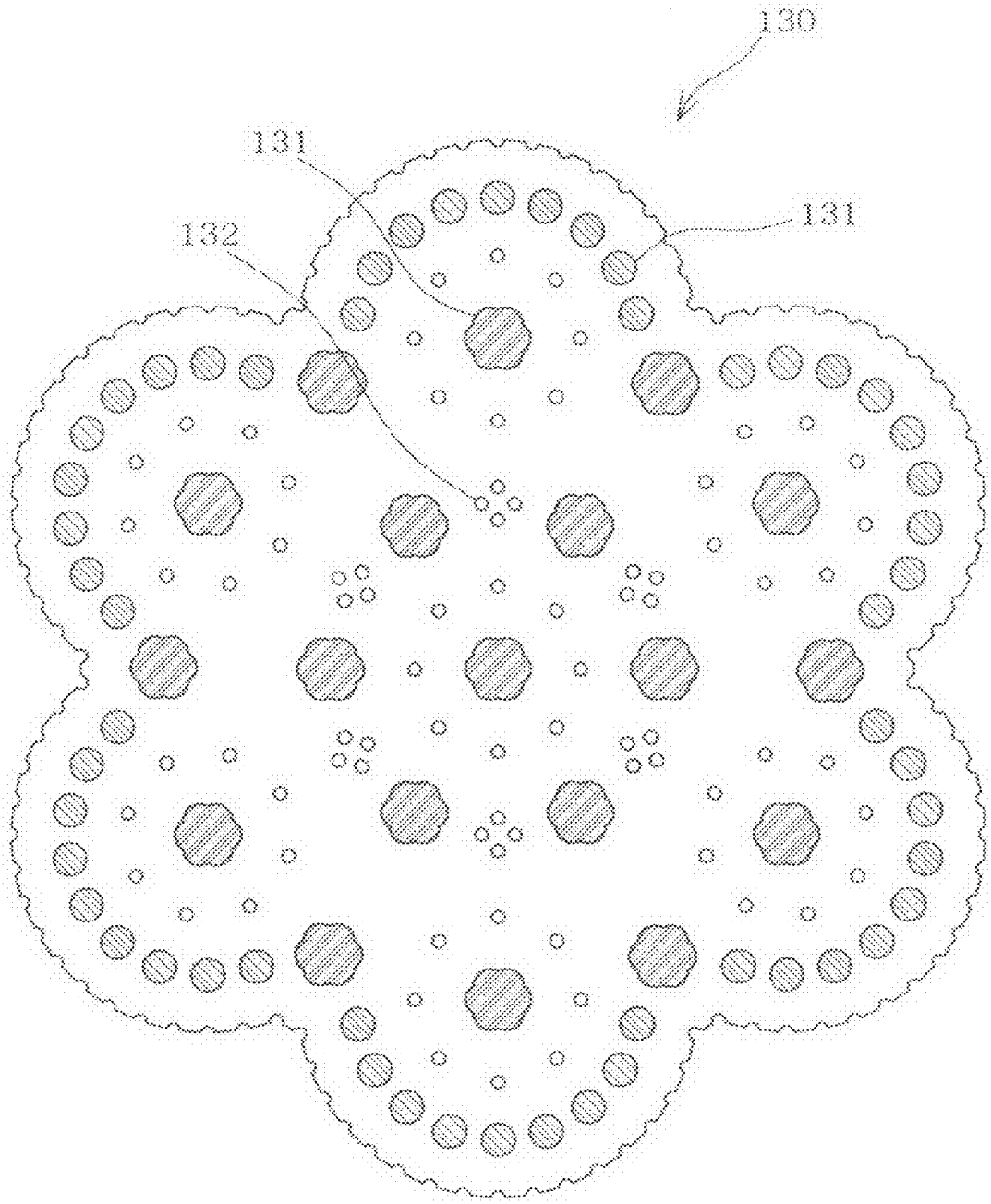
FIG. 8 schematically illustrates a finished product formed by the embosses and holes.

X coordinate 114 and Y coordinate 115 of embossing data 111 and holing data 112 indicate the location where the emboss and the hole is formed. Controller 80 drives X motor 76 and Y motor 77 of transfer unit 71 based on X coordinate 114 and Y coordinate 115 of pattern data 110. Workpiece 70 supported by frame 72 of transfer unit 71 is thus, transferred to the line of extension extending vertically from the center of projecting element 51 or needle 56 based on X coordinate 114 and Y coordinate 115. As a result, pattern 120 as shown in FIG. 7 made of embosses 121 and holes 122 are formed on workpiece 70 based on pattern data 110. In pattern 120 shown in FIG. 7, relatively large, shaded circular portion indicates emboss 121, whereas relatively small, circular portion indicates hole 122. Product 130 as such shown in FIG. 8 is created by cutting out workpiece 70 along the outline defined by the outermost holes 122 of pattern 120 made of embosses 121 and holes 122 with instruments such as scissors. In product 130, the shaded portion corresponds to embosses 131 and the inner region of relatively small, circular portion corresponds to holes 132.

Next, a description will be given on the parchment crafting process executed by sewing machine 10 configured as described above.

Figure 9:
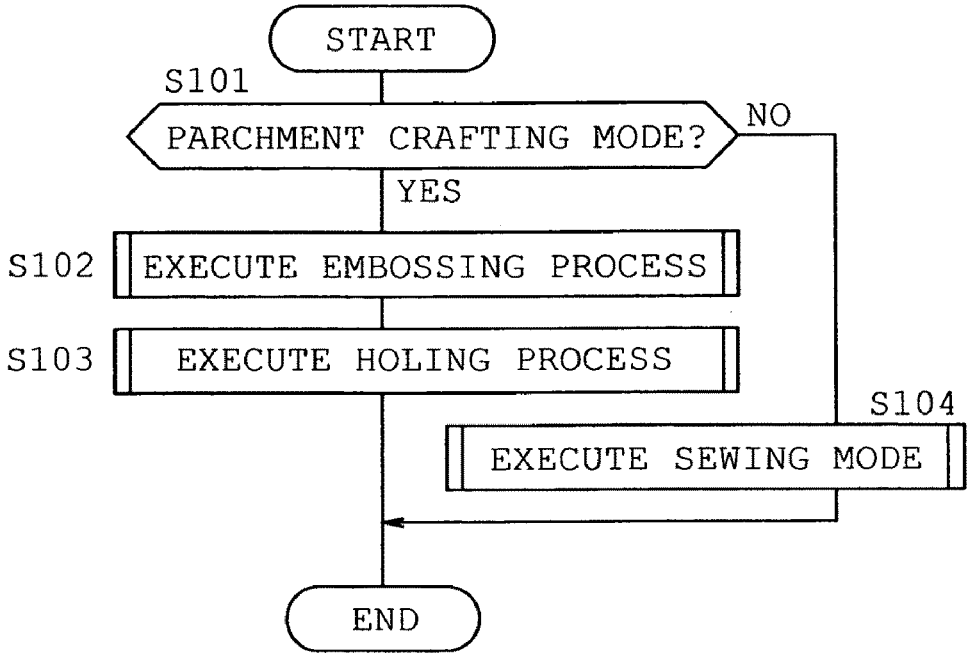
FIG. 9 indicates a process flow of parchment crafting executed by the sewing machine according to the exemplary embodiment.

First, the main routine of the parchment crafting process executed by sewing machine 10 will be described based on FIG. 9.

As the first step of the process, controller 80 determines whether or not the current process flow is running under the parchment crafting mode in which parchment crafting is executed (S101). As mentioned earlier, sewing machine 10 is capable of executing normal sewing operation in addition to parchment crafting, and thus, controller 80 determines whether the specified mode is a parchment crafting mode or a sewing mode. When in the parchment crafting mode, projecting element 51 is attached to presser bar 16 by way of adapter 52, and needle 56 is attached to needle bar 15. When in the sewing mode, on the other hand, presser foot not shown is attached to presser bar 16 and sewing needle not shown is attached to needle bar 15. Further, when in the sewing mode, a thread spool wound with needle thread and bobbin wound with wound with bobbin thread not shown are attached to sewing machine 10. Neither needle thread nor bobbin thread are used when in the parchment crafting mode, and thus, controller 80 ignores the outputs from a needle thread sensor not shown that detects the presence/absence of the needle thread and the outputs from bobbin thread amount sensor not shown that detects the remaining bobbin thread amount. In the present exemplary embodiment, when in the parchment crafting mode, sewing machine 10 has transfer device 71 attached to it, whereas when in the sewing mode, transfer device 71 is detached from sewing machine 10 in executing a normal sewing operation and attached to sewing machine 10 when executing an embroidery sewing operation.

Controller 80, when determining that parchment crafting mode is specified (S101: Yes), executes embossing process (S102) for forming embosses 121 and holing process (S103) for forming holes 122. In the present exemplary embodiment, embossing process and holing process are carried out in separate steps in which embossing process is executed entirely across workpiece 70 whereafter holing process is executed entirely across workpiece 70. Embossing process and holing process will be detailed afterwards. Controller 80, when determining that the sewing mode is set (S101: No), executes either the normal sewing operation or the embroidery sewing operation (S104).

Figure 10:
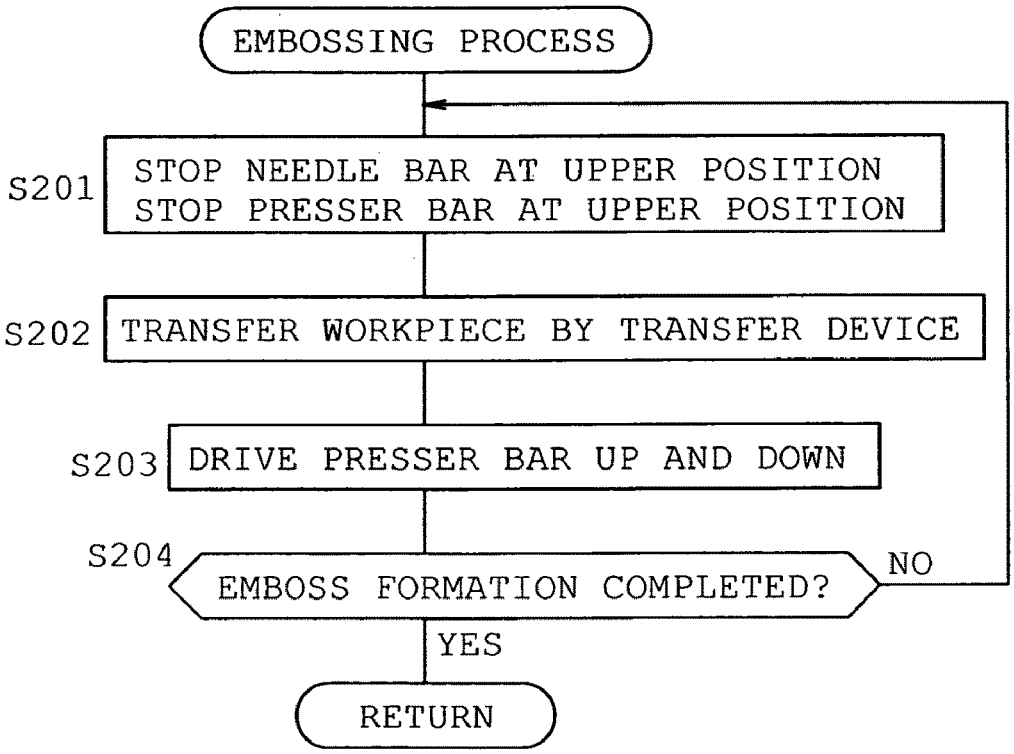
FIG. 10 schematically indicates a process flow of an embossing process.

Next, a description will be given on the embossing process based on FIG. 10.

When proceeding to the embossing process at S102 of the main routine, controller 80 drives needle bar 15, presser bar 16, and transfer device 71. To elaborate, controller 80 stops needle bar 15 and presser bar 16 at the upper position (S201). The upper position of needle bar 15 and presser bar 16 may be modified to a given position, such as the intermediate position, within the vertical reciprocable range besides the upper end.

In addition to stopping needle bar 15 and presser bar 16 at the upper position, controller 80 transfers workpiece 70 supported by frame 72 to the position for execution of embossing process (S202) by transfer device 71. Controller 80 transfers frame 72 based on embossing data 111 of pattern data 110. In the present exemplary embodiment, the center of projecting element 51 is distanced from the center of presser bar 16 by adapter 52 and is also distanced by a predetermined spacing from the center of needle 56 attached to needle bar 15. Thus, the spacing between projecting element 51 and needle 56 is considered as an adjustment value and controller 80 adds or subtracts the adjustment value to/from embossing data 111 in moving transfer device in the X and Y directions. Alternatively, embossing data 111 may be specified such that each of the X coordinates 114 and Y coordinates 115 reflects such adjustment value.

Controller 80, when driving needle bar 15, presser bar 16 and transfer device 71, energizes pulse motor 33 so that only presser bar 16 is reciprocated between the upper and lower position (S203) to form the embosses. Controller 80 controls the amount of descent of presser bar 16 based on depth 116 contained in pattern data 110. As described above, controller 80 reciprocates only presser bar 16 up and down to form embosses on workpiece cloth 70.

When presser bar 16 is driven up and down, controller 80 determines whether or not formation of all embosses 121 based on pattern data 111 contained in pattern data 110 have been completed (S204). Controller 80, when determining that all embosses 121 have been formed (S204: YES), returns the process flow to the main routine shown in FIG. 9. When, controller 80, on the other hand, determines that formation of embosses 121 has not been completed (S204: No), returns the process flow to step S201, and repeats S201 onwards until formation of every emboss 121 corresponding to every embossing data 111 contained in pattern data 110 is completed.

Figure 11:
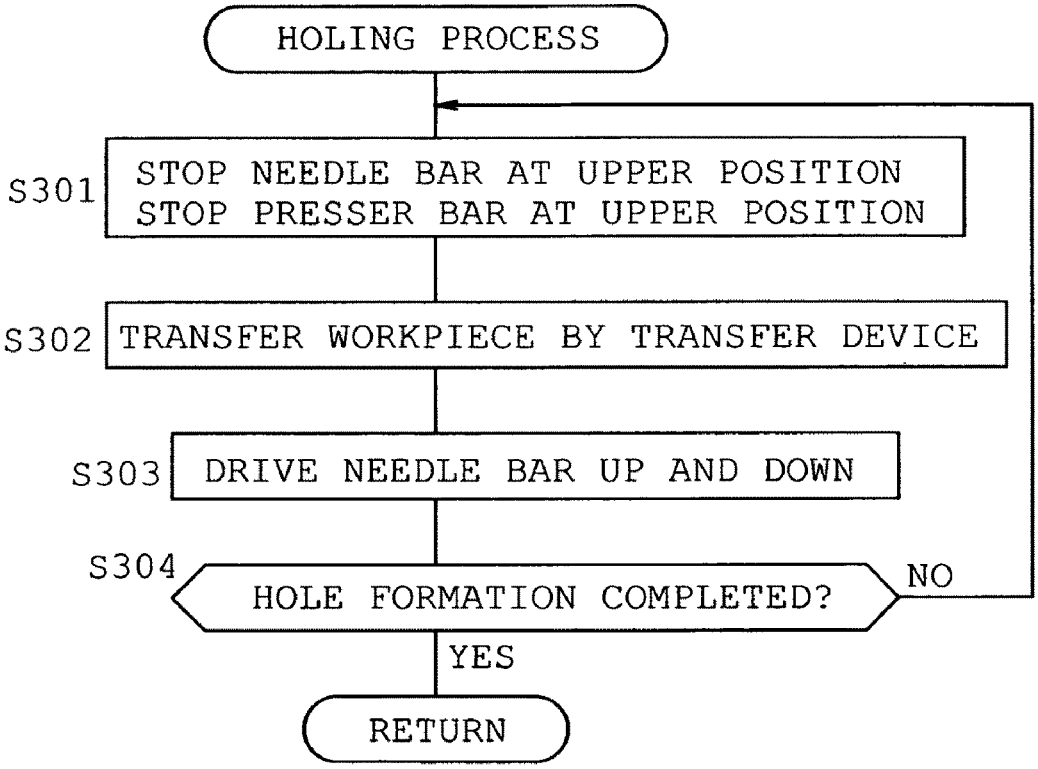
FIG. 11 schematically indicates a process flow of a holing process.

Next, a description will be given on the holing process based on FIG. 11.

When proceeding to the holing process at S103 of the main routine, controller 80 drives needle bar 15, presser bar 16, and transfer device 71. To elaborate, controller 80 stops needle bar 15 and presser bar 16 at the upper position (S301).

In addition to stopping needle bar 15 and presser bar 16 at the upper position, controller 80 transfers workpiece 70 supported by frame 72 to the position for execution of the holing process (S302) by transfer device 71. Controller 80 transfers frame 72 based on holing data 112 of pattern data 110. In the present exemplary embodiment, needle 56 is supported by needle bar 15 such that the central axis of needle 56 and needle bar 15 are collinear. Thus, controller 80 drives transfer device 71 in the X and Y directions based on X coordinates 114 and Y coordinates 115 of holing data 112.

Controller 80, when driving needle bar 15, presser bar 16 and transfer device 71, energizes sewing machine motor 30 so that only needle bar 15 is reciprocated between the upper and lower positions (S303) to form the holes. Needle bar 15 driven by sewing machine motor 30 is vertically reciprocated at the constant pitch which is employed in the normal sewing operation. Vertical movement of needle bar 15 and needle 56 forms holes 122 on workpiece 70.

When needle bar 15 is driven up and down, controller 80 determines whether or not formation of every hole 122 based on holing data 112 contained in pattern data 110 have been completed (S304). Controller 80, when determining that every hole 122 has been formed (S304: YES), returns the process flow to the main routine shown in FIG. 9. When, controller 80, on the other hand, determines that formation of holes 122 has not been completed (S304: No), returns the process flow to step S301, and repeats S301 onwards until formation of every hole 122 corresponding to every holing data 112 contained in pattern data 110 is completed.

Embosses 121 and holes 122 are formed in sequence on workpiece 70 as shown in FIG. 7 by projecting element 51 reciprocating up and down with presser bar 16, and by needle 56 reciprocating up and down with needle bar 15, respectively according to the above described procedures. Finally product 130 as such shown in FIG. 8 is created by cutting out workpiece 70 along the outline defined by the outermost holes 122 of pattern 120 with instruments such as scissors.

The above described exemplary embodiment of sewing machine 10 provides the following operation and effect.

Sewing machine 10 forms embosses 121 on workpiece 70 with projecting element 51 attached to presser bar 16. Projecting element 51 is moved up and down with presser bar 16 by utilizing presser bar vertically moving mechanism 27 provided at sewing machine 10. By placing workpiece 70 at a position opposing protruding tip 51 and moving presser bar 16 having protruding tip 51 attached to it up and down while transferring workpiece 70, embosses 121 are formed on a given position of workpiece 70. Thus, complex patterns made of multiplicity of embosses 121 can be readily formed.

Receiving section 63 of needle plate 17 serves as a flexible buffer or shock absorbing element made of rubber, for example. Thus, when projecting element 51 is transferred toward needle plate 17 along with the up and down movement of presser bar 16, the extremity of projecting element 51 contacts the buffer element of receiving section 63. Buffer element, being made of flexible material, reduces the shock imparted when the extremity of projection element 51 contacts it. Thus, noise produced at impact of projecting element 51 and workpiece 70 can be reduced to consequently reduce the noise produced throughout the entire parchment crafting work.

Presser bar 16 to which projecting element 51 is attached is controlled in its amount of movement toward workpiece 70 based on "depth 116" contained in pattern data 110. By modifying the movement amount of presser bar 16 based on "depth 116", the depth or force in which workpiece 70 is pressed by projecting element 51 is altered. For instance, when using tracing paper as workpiece 70, the contrast or whiteness, in this case, of emboss 121 varies depending upon the depth or the force in which projecting element 51 is pressed. Thus, by modifying the movement amount of presser bar 16, to which projecting element 51 is attached, the density/contrast of emboss 121 formed on workpiece 70 can be readily modified. Further, even if the depth or force in which workpiece 70 is pressed by projecting element 51 is modified, receiving section 63 serving as buffer element can absorb such variance.

Needle bar 15, on the other hand, has needle 56 attached to it in place of the sewing needle which is normally attached in executing a normal sewing operation. Because needle 56 is driven up and down along with needle bar 15 by utilizing needle bar vertically moving mechanism 26 provided with sewing machine 10, the existing functionalities of sewing machine 10 can be used efficiently. By placing workpiece 70 at a position opposing needle 56 and moving needle bar 15 having needle 56 attached to it up and down while transferring workpiece 70, holes 122 are formed on a given position of workpiece 70. Thus, complex patterns made of multiplicity of not only embosses 121 but also holes 122 can be readily formed.

Sewing machine 10 is provided with a transfer device 71 that transfers workpiece 70. Controller 80 is configured to control formation of both emboss 121 by projecting element 51 and holes 122 by needle 56 in coordination with the transfer of workpiece 70 with transfer device 71. Thus, when workpiece 70 is attached to frame 72 of transfer device 71 and pattern formation process is started, embosses 121 and holes 122 based on pattern data 111 are automatically formed on workpiece 70. Thus, complex patterns can be formed with accuracy in a short period of time.

Controller 80 is configured to form holes 122 on workpiece 70 based on holing data 112 after forming embosses 121 based on embossing data 111 contained in pattern data 110. Formation of hole 122 on workpiece 70 causes nearby peripheral portions of workpiece 70 to be reduced in strength. Thus, when emboss 121 is formed near hole 122, the lack in the strength of workpiece 70 may induce its deformation and destruction to reduce the accuracy in the shaping of the patterns formed. To address such concerns, the present exemplary embodiment forms holes 122 after forming embosses 121 on workpiece 70. Thus, patterns comprising neat and elaborate embosses 121 and holes 122 can be formed throughout the entire workpiece 70. Moreover, controller 80 forms holes 122 only after formation of all of embosses 121 have been completed. This further ensures the neatness and elaborateness of the formed patterns.

Next, a description will be given on modified exemplary embodiments of the present disclosure.

In the above described exemplary embodiment of sewing machine 10, pattern 120 is formed in two separate steps in which embosses 121 are initially formed throughout the entire workpiece 70, whereafter holes 122 are formed throughout the entire workpiece. Alternatively, workpiece may be divided into multiple sections and the sequence of emboss formation and hole formation may be carried out section by section meaning that the sections are processed one at a time until all the required embosses 121 and holes 122 are formed throughout the entire workpiece 70. According to the above alternative configuration, because embosses 121 and holes 122 are formed section by section, the amount of movement of workpiece 70 by frame 71 can be reduced. Thus, especially when patterns are formed on relatively sizeable workpiece 70, less time is expended on the transfer of workpiece 70, and consequently on the formation of the pattern.

In the above described exemplary embodiment of sewing machine 10, workpiece 70 is transferred by transfer device 71. However, transfer device 71 need not be attached to sewing machine 10 but instead, the user may manually move workpiece 70 back and forth and to the left and right. By allowing the user to manually move workpiece 70, patterns with hand made taste can be formed.

The above described exemplary embodiment of sewing machine 10 is further provided with needle plate 17 having receiving section 63 made of flexible buffer element. Receiving section 63 is not limited to such buffer element but may be replaced by a hole or a recess formed on needle plate 17. For instance, by providing a hole or a recess that corresponds to the shape of pointed tip 54 on needle plate 17, projecting element 51 plunges into workpiece 70 more reliably and more firmly to allow formation of sharp embosses with greater ease. By modifying the configuration of receiving section 63, the taste or the texture of embosses formed on workpiece 70 can be changed as desired.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a presser foot that is configured to press a workpiece;

a presser bar that has a lower end allowing detachable attachment of the presser foot;

a presser bar vertically moving mechanism that moves the presser bar up and down;

a presser bar driver that drives the presser bar vertically moving mechanism;

a needle plate that has an upper surface, the upper surface being configured to receive the workpiece;

a projecting element that is detachably attached to the presser bar and that is driven up and down with the presser bar as the presser bar is driven up and down by the presser bar driver through the presser bar vertically moving mechanism, the projecting element being configured to form embosses on the workpiece by downwardly pressing the workpiece; and a receiving section that is provided on the upper surface of the needle plate that opposes the projecting element to receive a tip of the projecting element.

2. The sewing machine according to claim 1, wherein the receiving section comprises a buffer element made of a flexible material.

3. The sewing machine according to claim 1, further comprising a specifier that specifies an amount of up and down movement of the presser bar, wherein the presser bar driver drives the presser bar vertically moving mechanism based on the amount of up and down movement specified by the specifier.

4. The sewing machine according to claim 1, further comprising:

a needle that is configured to penetrate the workpiece;

a needle bar that has a lower end allowing detachable attachment of the needle;

a needle bar vertically moving mechanism that moves the needle bar up and down;

a needle bar driver that drives the needle bar vertically moving mechanism; and a controller that selectively drives either the presser bar driver to drive the presser bar vertically moving mechanism or the needle bar driver to drive the needle bar vertically moving mechanism.

5. The sewing machine according to claim 4, further comprising a transfer device that is configured to transfer the workpiece in a front and rear direction represented as a Y direction and a left and right direction represented as an X direction orthogonal to the Y direction, wherein the controller is configured to execute transfer of the workpiece by the transfer device at least in either of the X direction and the Y direction in coordination with the up and down movement of the presser bar by the presser bar driver.

6. The sewing machine according to claim 5, further comprising a storage that stores embossing data and holing data, the embossing data providing a mapping between a transferred position of the workpiece to be transferred by the transfer device and a lowered position of the presser bar to be lowered by the presser bar driver, and the holing data providing a mapping between the transferred position of the workpiece to be transferred by the transfer device and a lowered position of the needle bar to be lowered by the needle bar driver, wherein the controller is configured to execute formation of holes on the workpiece by the needle based on the holing data after executing formation of embosses on the workpiece by the projecting element based on the embossing data.

7. The sewing machine according to claim 6, wherein the controller is configured to execute formation of the holes on an entire range of the workpiece based on the holing data after formation of the embosses on the entire range of the workpiece based on the embossing data.

8. The sewing machine according to claim 6, wherein the controller is configured to divide the workpiece into a plurality of sections, and formation of the embosses on the workpiece based on the embossing data and formation of the holes on the workpiece based on the holing data are configured to be executed section by section.

* * * * *